US009219304B2

(12) United States Patent
Nagahama

(10) Patent No.: US 9,219,304 B2
(45) Date of Patent: Dec. 22, 2015

(54) ELECTRONIC TIMEPIECE WITH INTERNAL ANTENNA

(71) Applicant: Seiko Epson Corporation, Tokyo (JP)

(72) Inventor: Toshitaka Nagahama, Shiojiri (JP)

(73) Assignee: Seiko Epson Corporation (JP)

( * ) Notice: Subject to any disclaimer, the term of this patent is extended or adjusted under 35 U.S.C. 154(b) by 287 days.

(21) Appl. No.: 14/016,350

(22) Filed: Sep. 3, 2013

(65) Prior Publication Data

US 2014/0085153 A1 Mar. 27, 2014

(30) Foreign Application Priority Data

Sep. 24, 2012 (JP) ..... 2012-209024

(51) Int. Cl.

| | |
|---|---|
| ***H01Q 1/12*** | (2006.01) |
| ***H01Q 1/44*** | (2006.01) |
| ***G04R 60/10*** | (2013.01) |
| *G04R 20/04* | (2013.01) |

(52) U.S. Cl.

CPC ..... *H01Q 1/44* (2013.01); *G04R 60/10* (2013.01); *G04R 20/04* (2013.01)

(58) Field of Classification Search

CPC ..... H01Q 1/44; G04R 20/04; G04R 60/10

USPC ..... 343/718, 720; 368/47, 278

See application file for complete search history.

(56) References Cited

U.S. PATENT DOCUMENTS

| | | | | |
|---|---|---|---|---|
| 6,373,439 | B1 * | 4/2002 | Zurcher et al. | 343/718 |
| 7,151,496 | B2 * | 12/2006 | Casagrande et al. | 343/718 |
| 8,913,466 | B2 * | 12/2014 | Fujisawa | 368/47 |
| 8,988,296 | B2 * | 3/2015 | Koskiniemi et al. | 343/718 |
| 8,995,236 | B2 * | 3/2015 | Fujisawa | 368/47 |
| 2011/0013491 | A1 | 1/2011 | Fujisawa | |

FOREIGN PATENT DOCUMENTS

| | | | |
|---|---|---|---|
| JP | 2011-021929 | A | 2/2011 |
| JP | 2013050336 | A | 3/2013 |

* cited by examiner

*Primary Examiner* — Tho G Phan

(74) *Attorney, Agent, or Firm* — Harness, Dickey & Pierce, P.L.C.

(57) ABSTRACT

An electronic timepiece has a case; a time display unit housed in the case; an annular dielectric that is housed in the case and has a conductive driven element to which a specific potential is supplied; and a conductive ground plane with an annular shape that is housed in the case and supplied with ground potential. The dielectric body and the ground plane are disposed coaxially to the same center axis with the gap therebetween in the axial (z-axis) direction less than or equal to the thickness of the dielectric in the axial direction.

8 Claims, 13 Drawing Sheets

ELECTRONIC TIMEPIECE WITH INTERNAL ANTENNA

BACKGROUND

1. Technical Field

The present invention relates to an electronic timepiece with an internal antenna.

2. Related Art

Japanese Unexamined Patent Appl. Pub. JP-A-2011-021929 discloses a GPS (Global Positioning System) wristwatch 1 that has an annular antenna 11 and a round solar panel support substrate 120 disposed directly below the antenna 11. As shown in FIG. 4 of JP-A-2011-021929, the antenna 11 has an annular dielectric substrate 111, and a conductive antenna electrode 112 (including an antenna body 113, coupling part 114, and feed part 115) formed on the surface of the dielectric substrate 111. The solar panel support substrate 120 is a conductive substrate that supports the dial 2 and solar panel 120A, and functions as a ground plane connected to a connection terminal of a circuit board 25.

The wristwatch 1 disclosed in JP-A-2011-021929 causes the annular antenna body 113 formed on the surface of the dielectric substrate 111 and the solar panel support substrate 120 (ground plane) to resonate, and receives signals from GPS satellites. Because the induced EMF increases as the magnetic flux passing through the plane of the loop increases, the reception performance of the loop antenna increases. However, because the open part of the annular dielectric substrate 111 is blocked directly below the dielectric substrate 111 by the round solar panel support substrate 120 connected to the ground terminal, little magnetic flux passes through the loop plane and the reception performance of the antenna is reduced.

SUMMARY

The present invention is directed to the foregoing problem, and an object of the invention is to improve the reception performance of the antenna in an electronic timepiece with an internal antenna that receives signals by resonance between a ground plane and a driven element disposed on a dielectric.

To achieve the foregoing object, an electronic timepiece with an internal antenna according to the invention has a case; a time display unit that is housed in the case and displays time; an annular dielectric body that is housed in the case and has disposed thereto a conductive driven element to which a specific potential is supplied; and a conductive ground plane with an annular shape that is housed in the case and supplied with ground potential; wherein the dielectric body and the ground plane are disposed coaxially to the same center axis with the gap therebetween in the axial direction less than or equal to the thickness of the dielectric in the axial direction.

Because the ground plane and the dielectric in this aspect of the invention are both annular, the inside part of the rings is open. The ground plane and the dielectric with the driven element disposed thereto are coaxial, and the distance therebetween in the axial direction is less than or equal to the thickness of the dielectric in the axial direction. Because the ground plane and dielectric are disposed in the axial direction with at least part of the openings therein overlapping, the opening in the dielectric is not blocked by the ground plane. The magnetic flux passing through the loop plane of the loop antenna can therefore be increased, and the reception performance of the antenna can be increased, compared with the configuration disclosed in JP-A-2011-021929.

The time display unit may indicate the time by rotating hands on a center pivot over a dial, or have an LCD panel with a display area of a size equal to the dial and display the time by displaying an image of a dial and hands in the display area, or display time digitally on an LCD panel, for example.

Annular means a shape like an endless ring with no break therein, and the shape of the ring could be round, oval, rectangular, or other polygon.

The driven element may be formed on the surface of the dielectric by plating or a silver paste printing process, or embedded in the dielectric by insert molding, for example.

In an electronic timepiece with internal antenna according to another aspect of the invention, the ground plane preferably has a plurality of supply parts to which the ground potential is supplied. These supply parts are, for example, conductive pins or conductive springs.

To produce resonance between the driven element and ground plane and receive a radio signal, holding the potential difference between the driven element and ground plane constant is important, and the stability of the ground potential in the ground plane greatly affects the sensitivity and directivity of the antenna. More particularly, when the shape of the ground plane is a ring, the distribution of the ground potential in the ground plane can easily become uneven if there is only one supply part, leading to a loss of reception performance and variation in directivity. By disposing plural supply parts on the ground plane, this aspect of the invention solves this problem and stabilizes the ground potential in the ground plane. The reception performance of the antenna can therefore be improved, and good directivity can be maintained.

In an electronic timepiece with internal antenna according to another aspect of the invention, the plural supply parts are disposed at equal angles from the center of the ground plane ring. Because this configuration also stabilizes the ground potential in the ground plane, the reception performance of the antenna can therefore be improved, and good directivity can be assured.

In an electronic timepiece with internal antenna according to another aspect of the invention, the driven element is an endless ring or a ring with a notch therein, and has one driven part to which the specific potential is fed; and when the dielectric and ground plane are seen in plan view from the axial direction of the ring, the plural supply parts are disposed symmetrically (line symmetrically) to a line joining the center of the ground plane ring and the driven part.

This configuration also stabilizes the ground potential in the ground plane, and can therefore improve the reception performance of the antenna, and assure good directivity.

More specifically, by disposing plural supply parts symmetrically to a line joining the center of the annular ground plane and the driven part, delay in high frequency components in the driven element can be reduced symmetrically on both sides of the driven part, and good directivity can be assured in the antenna.

In an electronic timepiece with internal antenna according to another aspect of the invention, the driven element is a ring with a notch therein, and has one driven part to which the specific potential is fed; a supply part to which the ground potential is supplied is disposed to one place on the ground plane; and when the dielectric and ground plane are seen in plan view from the axial direction of the ring, the supply part is disposed to a part in a range from the midpoint between the ends of the driven element and the driven part.

To produce desirable resonance between the driven element that is shaped like a ring with a notch therein (such as C-shaped), and the annular (such as O-shaped) ground plane, stabilizing the ground potential in the part of the ground plane overlapping the driven element is important. Therefore, when there is only one supply part disposed to the ground plane, the supply part is preferably in the area of the ground plane overlapping the driven element, such as disposing the supply part at the part corresponding to the midpoint between the ends of the driven element. Furthermore, considering delay of the high frequency component in the driven element, if the driven element is divided into two parts by the driven part, the supply part is preferably disposed to the long side.

Based on the above, when only one supply part is disposed to the ground plane, the ground potential in the part of the ground plane superimposed with the driven element can be efficiently stabilized by disposing the supply part to the part corresponding to the area from the midpoint between the ends of the driven element to the driven part when the dielectric and ground plane are seen in plan view from the axial direction of the ring. The reception performance of the antenna can therefore be improved and good directivity can be assured.

In an electronic timepiece with internal antenna according to another aspect of the invention, the case has a conductive case body that has a cylindrical shape and is supplied with the ground potential; the gap between the inside surface of the case body and the outside surface of the dielectric is less than or equal to the thickness of the dielectric; and the overlap of the case body and the dielectric in the axial direction is greater than or equal to ⅕ the thickness of the dielectric.

This aspect of the invention can increase the reception performance of the antenna and assure good directivity because the driven element can be made to resonate with both the ground plane and the case. The size of the ground plane can also be reduced because the case is also a resonator.

In an electronic timepiece with internal antenna according to another aspect of the invention, the case has a conductive case body with a cylindrical shape, and a conductive back cover connected to the case body; and the ground potential is also supplied to the case body and the back cover.

This aspect of the invention can also improve the reception performance of the antenna because the case body and back cover of the outside case also function as a ground plane, and reflect radio signals entering from the opposite side as the back cover to the antenna (dielectric and driven element) in an electronic timepiece with internal antenna.

In an electronic timepiece with internal antenna according to another aspect of the invention, a conductive parasitic element that is an endless ring or a ring with a notch therein is disposed to the dielectric with a gap to the driven element.

Like the driven element, the parasitic element may be formed on the surface of the dielectric by plating or a silver paste printing process, or embedded in the dielectric by insert molding, for example.

In this aspect of the invention, the driven element and parasitic element are disposed with space therebetween to an annular dielectric. Because current is also induced in the parasitic element when current flows to the driven element, the driven element and parasitic element couple electromagnetically, and together function as an antenna element that converts electromagnetic waves to current. For example, the length of the driven element disposed to the dielectric can be set appropriately by setting the length of the parasitic element disposed to the dielectric to resonate to the radio signals to be received. The impedance of the antenna (dielectric, driven element, and parasitic element), and the circuit electrically connected to the antenna, can also be easily matched.

Furthermore, by electromagnetically coupling the parasitic element to the driven element, the resonance frequency of the antenna can be reduced and the impedance characteristic improved. Return loss at the resonance frequency can therefore be reduced, and the reception performance of the antenna to the radio signals to be received can be increased by matching the resonance frequency of the antenna to the signals to be received.

Other objects and attainments together with a fuller understanding of the invention will become apparent and appreciated by referring to the following description and claims taken in conjunction with the accompanying drawings.

DESCRIPTION OF EMBODIMENTS

Preferred embodiments of the present invention are described below with reference to the accompanying figures. Note that the size and scale of parts shown in the figures differ from the actual size and scale for convenience. Furthermore, the following examples are specific preferred embodiments of the invention and describe technically desirable limitations, and the scope of the invention is not limited thereby unless such limitation is specifically stated below.

Figure 1:
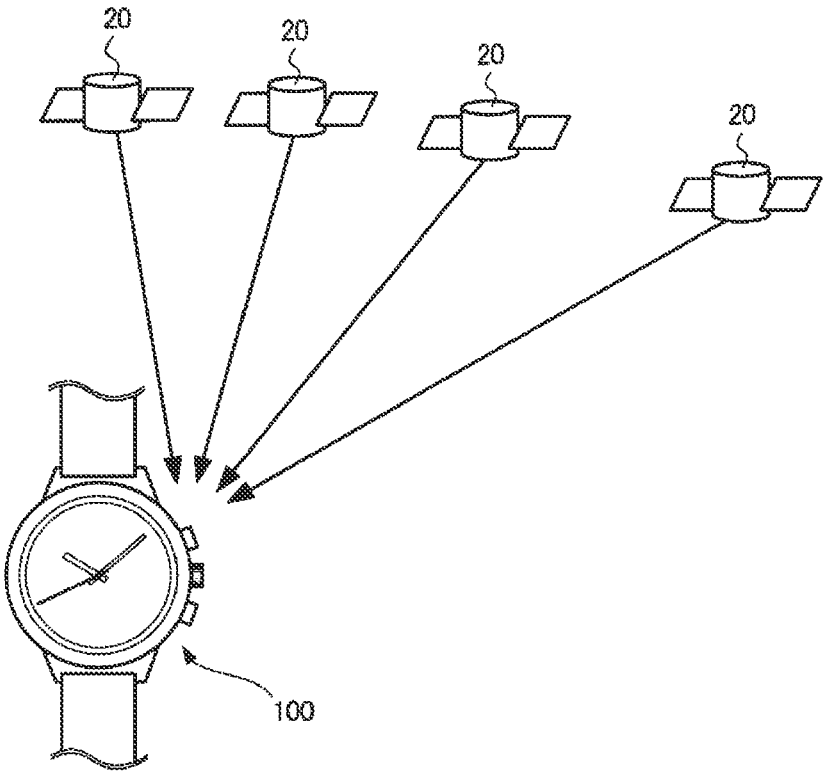
FIG. 1 shows the configuration of a time adjustment system using the GPS system.

FIG. 1 shows the general configuration of a time adjustment system using the GPS system.

The electronic timepiece 100 is a wristwatch that receives signals (radio signals) from GPS satellites 20 and adjusts the time based thereon, and displays the time on the surface (side) (referred to below as the "face") on the opposite side as the surface (referred to below as the "back") that contacts the wrist.

Each GPS satellite 20 is on a semi-geosynchronous orbit, and transmits a C/A (Coarse/Acquisition) code and navigation messages superimposed on a 1.57542 GHz RF signal (L1 signal). The 1.57542 GHz signal carrying a C/A code and navigation message is referred to herein as simply a "satellite signal." These satellite signals are right-handed circularly polarized waves.

A C/A code is a 1023-bit pseudorandom noise code unique to a specific GPS satellite 20. Each GPS satellite 20 carries an atomic clock, and the highly precise time information ("GPS time information" below) kept by the atomic clock is included in the navigation message as the time that the satellite signal was transmitted by the GPS satellite 20. The time difference of the atomic clock onboard each GPS satellite 20 is measured by the ground control segment, and a time correction parameter for correcting this time difference is also included in the navigation message. Precise orbit information (ephemeris) for the GPS satellite 20, general orbit information (almanac) for all GPS satellites 20 in the constellation, a UTC offset value indicating the offset between UTC (Coordinated Universal Time) and the GPS time, and an ionospheric correction parameter are also included in the navigation message.

After spectrum spreading of the navigation message with the C/A code, the GPS satellite 20 produces a satellite signal by BPSK (binary phase shift keying) modulation multiplying the spread-spectrum signal with the 1.57542 GHz carrier. The electronic timepiece 100 extracts the navigation message from the received satellite signal by reversing the flow of satellite signals generation by the GPS satellite 20 (demodulating the BPSK modulated signal, then spread-spectrum despreading). Because the C/A code used for spectrum spreading is different for each GPS satellite 20, the electronic timepiece 100 can determine from which GPS satellite 20 the signal was received.

The electronic timepiece 100 can accurately adjust the time kept by the electronic timepiece 100 (below, the "internal time") to the correct current time using the GPS time information and time correction parameter contained in the satellite signals received from a single GPS satellite 20.

The electronic timepiece 100 can also acquire positioning information (location information such as the latitude and longitude) indicating the current location of the electronic timepiece 100 by receiving satellite signals from at least three (normally four) or more GPS satellites 20 and extracting the GPS time information and orbit information (ephemeris) of each GPS satellite 20 contained in the received signals. The acquired positioning information can also be used to adjust the time zone.

The electronic timepiece 100 also calculates the distance to each GPS satellite 20 from the difference between the time that the satellite signal was received (arrival time) and the transmission time contained in the satellite signal, and calculates the current location of the electronic timepiece 100 by triangulation based on the distance to three or more GPS satellites 20. The electronic timepiece 100, however, uses a crystal oscillator, and cannot keep time as precisely as an atomic clock. A time error as short as one-millionth of a second results in a distance error of approximately 300 meters. As a result, the electronic timepiece 100 normally receives satellite signals from four or more GPS satellites 20 to correct the internal time while acquiring positioning information.

Figure 2:
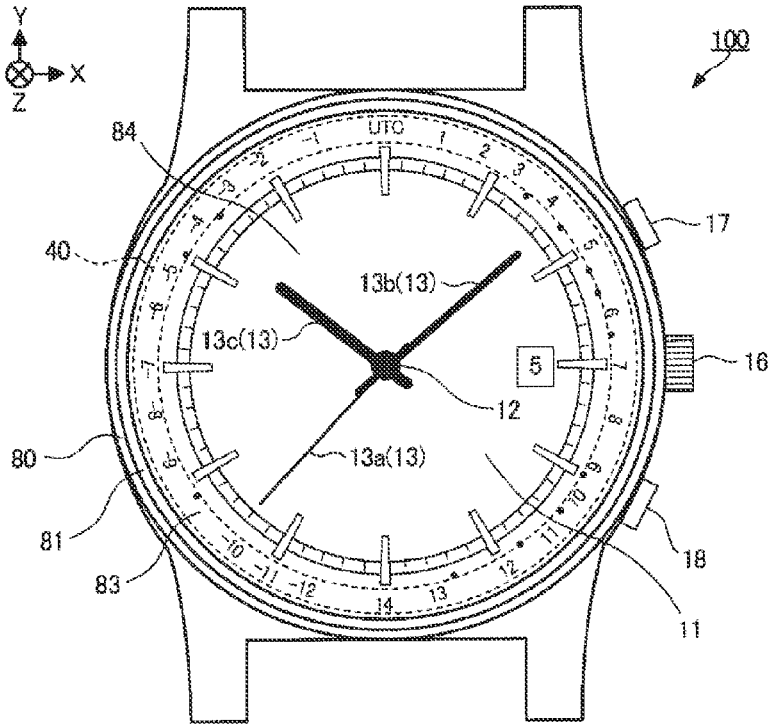
FIG. 2 is a plan view of an electronic timepiece.

FIG. 2 is a plan view of the electronic timepiece 100.

As shown in FIG. 2, the electronic timepiece 100 has a cylindrical outside case 80 made of metal or other conductive material. An annular bezel 81 made of a non-conductive material such as ceramic or plastic is fit to the top (face side) of the case 80, and the opening in the bezel 81 is covered by a transparent crystal 84.

An annular dial ring 83 made of a non-conductive material such as ceramic or plastic is disposed inside the bezel 81, and a round dial 11 is disposed inside the dial ring 83. Bar-shaped hour markers are disposed every 30 degrees around the dial ring 83, and part of each hour marker protrudes above the top of the dial 11. Additional minute markers are also inscribed every 6 degrees between adjacent hour markers. The markers could alternatively be disposed on the dial 11, and the numbers 1 to 12 could be used instead of the bar-shaped hour markers. The appearance of the dial ring 83 and the dial 11 are thus not limited to the appearance shown in the figure.

Hands 13 (second hand 13*a*, minute hand 13*b*, and hour hand 13*c*) that turn on a center pivot 12 and indicate the time, for example, are disposed above the dial 11. The user can see the dial ring 83, dial 11, and hands 13 through the crystal 84. An annular antenna 40 is disposed below (on the back side of) the dial ring 83.

The electronic timepiece 100 also has a 16 and buttons 17, 18. By manipulating the crown 16 and buttons 17, 18, the user can set the electronic timepiece 100 to a time information acquisition mode or positioning information acquisition mode. The time information acquisition mode is an operating mode for receiving satellite signals and acquiring the GPS time information and time correction parameter from at least one GPS satellite 20, and adjusting the internal time to the correct time. The positioning information acquisition mode is an operating mode for receiving satellite signals from at least three GPS satellites 20 to acquire the current location of the electronic timepiece 100 and adjust the internal time to the correct time reflecting the local time zone. The electronic timepiece 100 can also regularly automatically execute the time information acquisition mode and the positioning information acquisition mode.

The internal structure of the electronic timepiece 100 is described next.

Figure 3:
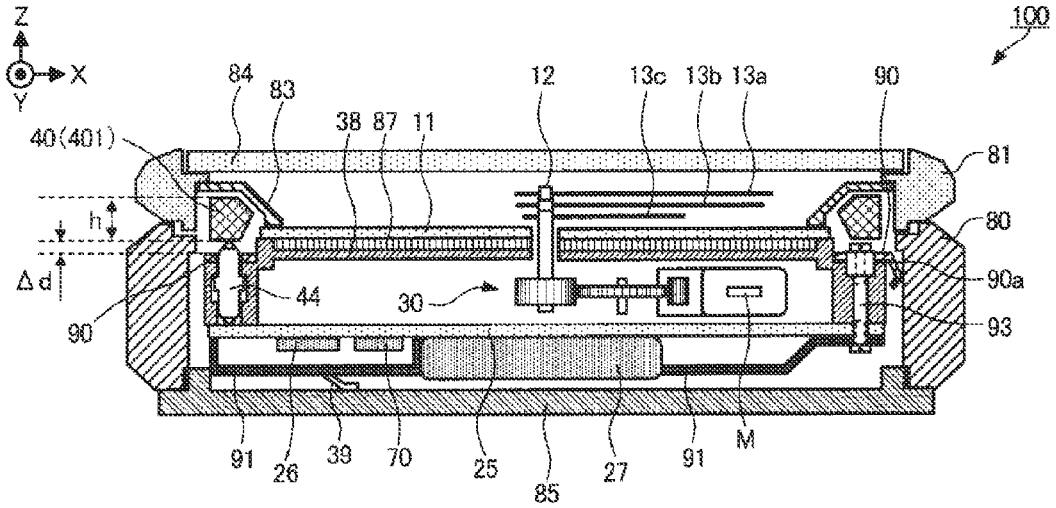
FIG. 3 is a section view showing main parts of the electronic timepiece.
Figure 4:
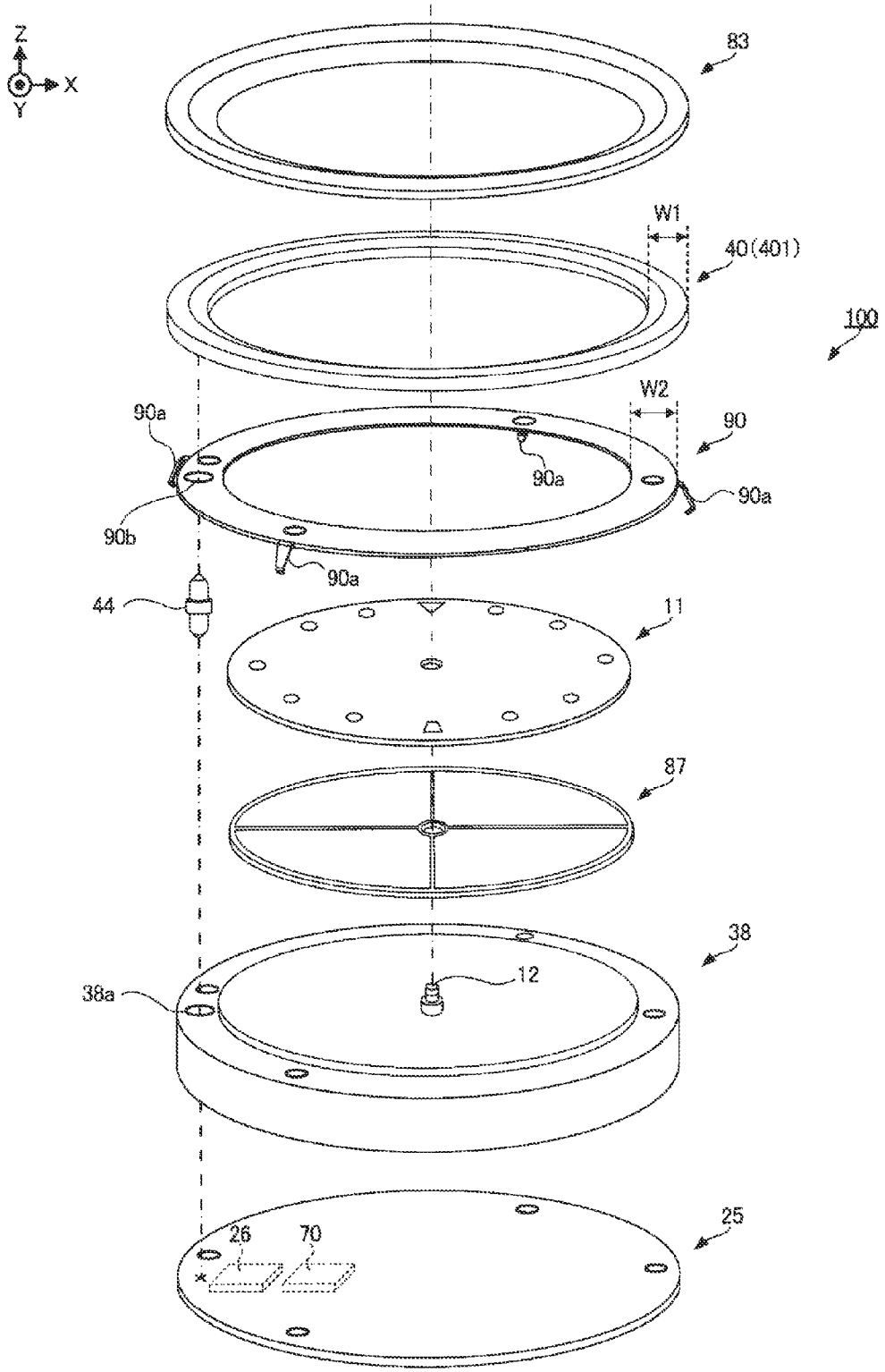
FIG. 4 is an exploded oblique view of main parts of the electronic timepiece.

FIG. 3 is a section view showing main parts of the electronic timepiece 100, and FIG. 4 is an exploded oblique view showing parts of the electronic timepiece 100.

As shown in FIG. 3, the annular bezel 81 is fit to the top (face side) of the cylindrical case 80, and the top opening of the bezel 81 is covered by the round crystal 84. The opening on the bottom (back side) of the case 80 is covered by a back cover 85 made of stainless steel, titanium, or other conductive material. the case 80 and back cover 85 screw together, for example. The outside case of the electronic timepiece 100 thus includes the case 80, bezel 81, crystal 84, and back cover 85.

The annular dial ring 83 is disposed to the inside circumference of the bezel 81 below the crystal 84. The outside circumference side of the dial ring 83 is flat and contacts the inside surface of the bezel 81, and the inside circumference side is bevelled and slopes to the inside. A donut-shaped storage space is formed below the dial ring 83, and the annular antenna 40 is housed in this space.

The antenna 40 is disposed on the inside side of the inside circumference of the case 80 and bezel 81, and the top of the antenna 40 is covered by the dial ring 83.

An annular ground plane 90 made of metal or other conductive material is disposed below the antenna 40. As shown in FIG. 4, four holes are formed in the ground plane 90 in addition to a through-hole 90*b* for the feed pin 44, and a conductive pin 93 as shown in FIG. 3 is disposed in each of these four holes. Four holes for passing conductive pins 93 are also formed in the main plate 38 and the edge of the circuit board 25 matching the holes in the ground plane 90. See FIG. 4.

The ground potential of the circuit block including a GPS reception unit 26 and control unit 70 is supplied through the circuit board 25 to the conductive pins 93, and the ground potential of the four conductive pins 93 is supplied to the ground plane 90. Four conductive springs 90*a* are also disposed to the ground plane 90 as shown in FIG. 4. Part of each conductive spring 90*a* contacts the inside surface of the case 80 with the urging force of the spring (see FIG. 3), and the conductive springs 90*a* are thereby electrically connected to the case 80. The ground potential is therefore also supplied through the ground plane 90 (conductive springs 90*a*) to the case 80.

As described in further detail below, the antenna 40 includes an annular base 401 made of a dielectric material, and a parasitic element 402 and a driven element 403 disposed on the base 401 (see FIG. 6). As shown in FIG. 4, the base 401 of the antenna 40 and the ground plane 90 are coaxial to each other and to the center pivot 12. As shown in FIG. 3, the gap ⊗ d on the z-axis between the base 401 and ground plane 90 is less than or equal to h, where h is the thickness on the z-axis of the base 401 of the antenna 40. The base 401 of the antenna 40 and the ground plane 90 are thus disposed on the z-axis so that the center axis of each is the same and the distance therebetween on the z-axis is a gap •d of h or less. The gap •d between the antenna 40 (base 401) and the ground plane 90 is h or less in order to make the ground plane 90 and the driven element 403 disposed to the base 401 resonate and receive radio waves (satellite signals). If this gap ⊗ d is too great, the ground plane 90 and driven element 403 will not resonate and signals cannot be received.

The outside circumference of the ground plane 90 is preferably greater than the outside circumference of the base 401 of the antenna 40 in order to make the ground plane 90 and the driven element 403 disposed to the base 401 resonate desirably. The width W2 of the ground plane 90 on the x-y plane is preferably greater than the width W1 of the base 401 of the antenna 40 on the x-y plane (FIG. 4). However, the outside circumference of the ground plane 90 could be less than or equal to the outside circumference of the base 401, and the width W2 of the ground plane 90 less than or equal to the width W1 of the base 401. If the outside circumference of the ground plane 90 is less than or equal to the outside circumference of the base 401, however, the width W2 of the ground plane 90 must be at least ⅓ or more of the width W1 of the base 401.

The dial 11 and solar panel 87 are disposed inside the antenna 40. The dial 11 is made of plastic or other optically transparent non-conductive material.

The solar panel 87 is a round disc having plural solar cells (photovoltaic devices) that convert light energy to electrical energy (power) connected in series. The dial 11 and solar panel 87 are superimposed with each other and have a center hole through which the center pivot 12 passes.

The main plate 38 made of plastic, ceramic, or other non-conductive material is disposed below the solar panel 87. The center pivot 12 extends through the solar panel 87 and main plate 38 in the thickness direction between the face and back. The center pivot 12 is the center of the electronic timepiece 100 when the electronic timepiece 100 is seen from the direction perpendicular to the dial 11 (that is, when the electronic timepiece 100 is seen in plan view). The hands 13 (13*a* to 13*c*) are disposed between the crystal 84 and the dial 11 inside the inside circumference of the antenna 40 as shown in FIG. 3.

A drive mechanism 30 that causes the center pivot 12 to turn and drives the hands 13 is disposed below the main plate 38 as shown in FIG. 3. The drive mechanism 30 includes a stepper motor M and wheel train, and drives the hands 13 by the stepper motor M causing the center pivot 12 to turn through the wheel train. For example, the hour hand 13*c* turns one revolution in 12 hours, the minute hand 13*b* turns one revolution in 60 minutes, and the second hand 13*a* turns one revolution in 60 seconds. The time display unit includes, for example, the dial 11, center pivot 12, hands 13 (13*a* to 13*c*), and the drive mechanism 30.

The circuit board 25 is disposed below the main plate 38 and drive mechanism 30. A circuit block including a GPS reception unit 26 and control unit 70 is disposed on the bottom (on the surface facing the back of the wristwatch) of the circuit board 25. The GPS reception unit 26 is a single-chip IC module, for example, and includes analog and digital circuits. The control unit 70 controls the operation of the GPS reception unit 26 and drive mechanism 30. A storage battery 27 is disposed on the bottom of the circuit board 25 (FIG. 3). The storage battery 27 in this embodiment is a lithium ion battery, and is charged by the power produced by the solar panel 87.

A wiring pattern for supplying the ground potential, and a wiring pattern for supplying a specific potential to feed the antenna 40, are formed on the circuit board 25. The feed pin 44 is a pin connector made of metal or other conductive material, and has an internal coil spring. As shown in FIG. 4, the feed pin 44 is electrically connected through through-holes 38*a*, 90*b* in the main plate 38 and ground plane 90 to the top of the circuit board 25 and the bottom of the antenna 40. The top end of the feed pin 44 contacts the bottom of the antenna 40 (more specifically, the coupling part 404 described below) due to the urging force of the coil spring. The bottom of the feed pin 44 likewise contacts the top of the circuit board 25 (more specifically, the part where the wiring pattern supplying a specific potential is formed) due to the urging force of the coil spring. A specific potential is fed to the antenna 40 through the feed pin 44.

The GPS reception unit 26 and control unit 70 are covered by a shield 91 made of metal or other conductive material as shown in FIG. 3. The ground potential is supplied to the shield 91, and the ground potential is further supplied through the shield 91 and a metal circuit support 39 to the back cover 85 and case 80. The ground potential is also supplied through the circuit board 25 and conductive pins 93 to the ground plane 90 and case 80. The ground potential is thus supplied to the ground plane 90 on a path through the circuit board 25 and conductive pins 93, and ground potential is also supplied on a path through the shield 91, circuit support 39, back cover 85, case 80, and conductive springs 90*a*. Of the outside case members through which the ground potential is supplied, the case 80 and back cover 85 also function as a ground plane, and reflect satellite signals entering from the crystal 84 to the antenna 40.

The members constituting the ground potential supply path (such as the shield 91, circuit support 39, back cover 85, conductive pin 93, ground plane 90, and conductive springs 90*a*) are processed with gold plating or anticorrosion coating on the contact surfaces between the members. The conductive pins 93 are screwed tight. Contact resistance between the members of the ground potential supply path can therefore be held as low as possible for a long time.

Figure 5:
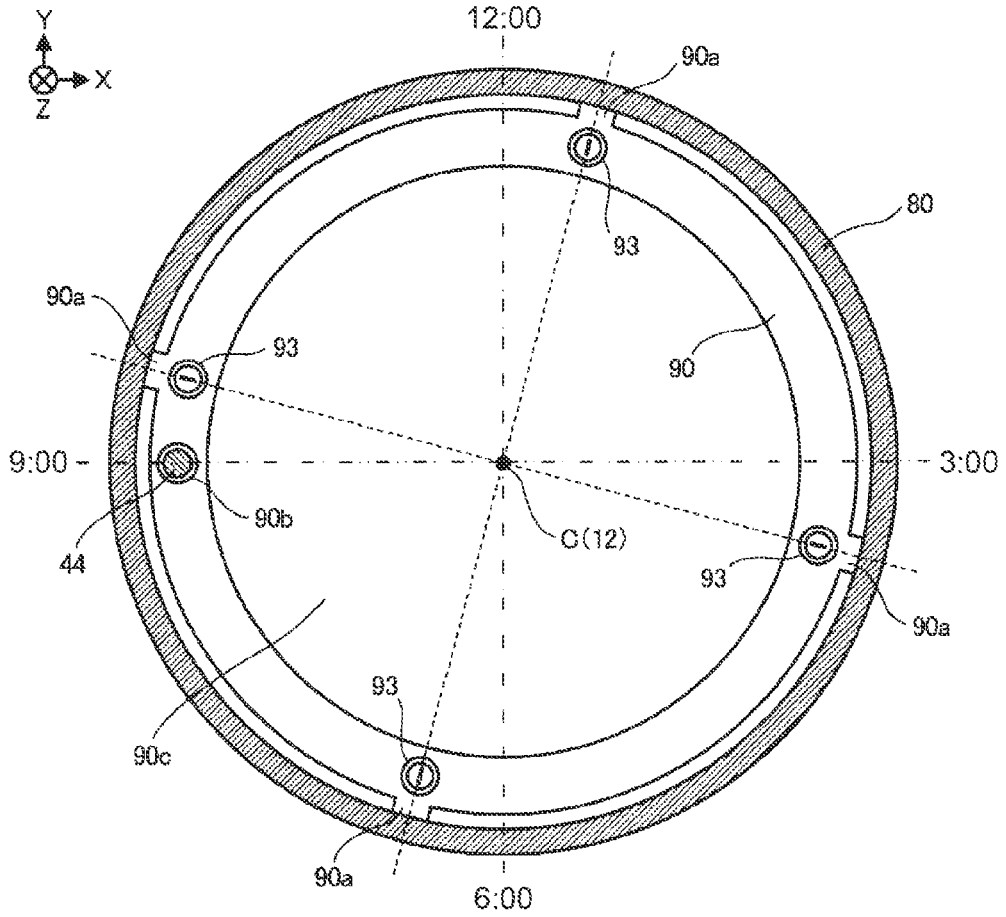
FIG. 5 is a plan view showing the ground plane and casing.

FIG. 5 is a plan view of the ground plane 90 and case 80.

The through-hole 90*b* through which the feed pin 44 passes is formed in the ground plane 90 at the 9:00 position relative to the center C of the ground plane 90 ring. Four conductive pins 93 are attached to the ground plane 90 at equiangular (90 degree) positions around the center C. Four conductive springs 90*a* formed in unison with the ground plane 90 are also disposed at equiangular (90 degree) positions around the center C in the outside edge of the ground plane 90. Part of each conductive spring 90*a* contacts the inside circumference surface of the case 80 due to the urging force of the spring, and the ground potential is therefore also supplied from the case 80 through the conductive springs 90*a* to the ground plane 90. The ground plane 90 also has an opening 90*c* in the center.

Including the conductive pins 93 and conductive springs 90*a*, there are thus 8 supply parts through which the ground potential is supplied to the ground plane 90. The ground potential can therefore be stabilized in the ground plane 90. The stability of the ground potential can also be increased when the electronic timepiece 100 is worn on the wrist because the body also acts as a ground through the back cover 85 and case 80.

Figure 6A:
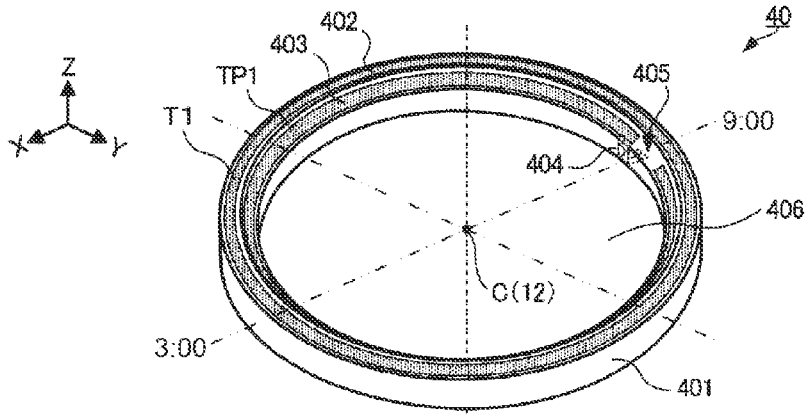
FIG. 6A to FIG. 6C are used to describe the structure of the antenna.
Figure 6B:
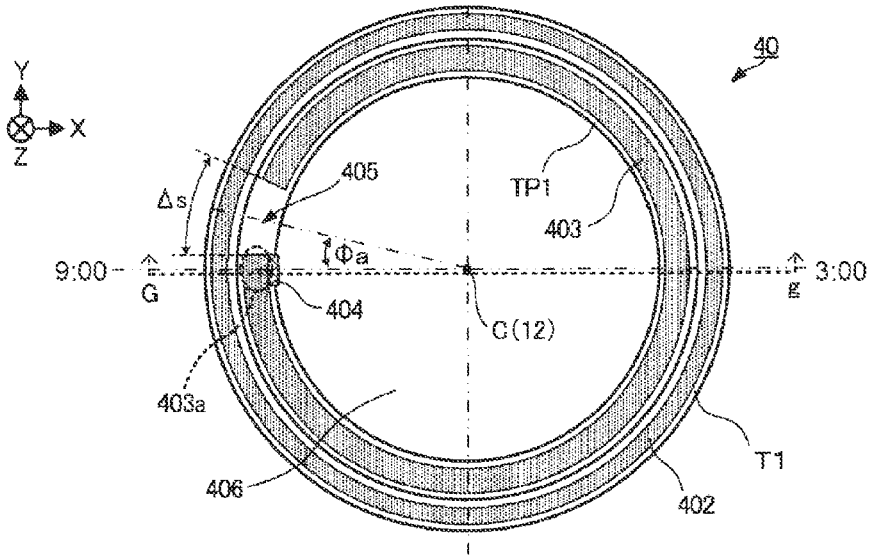
Figure 6C:
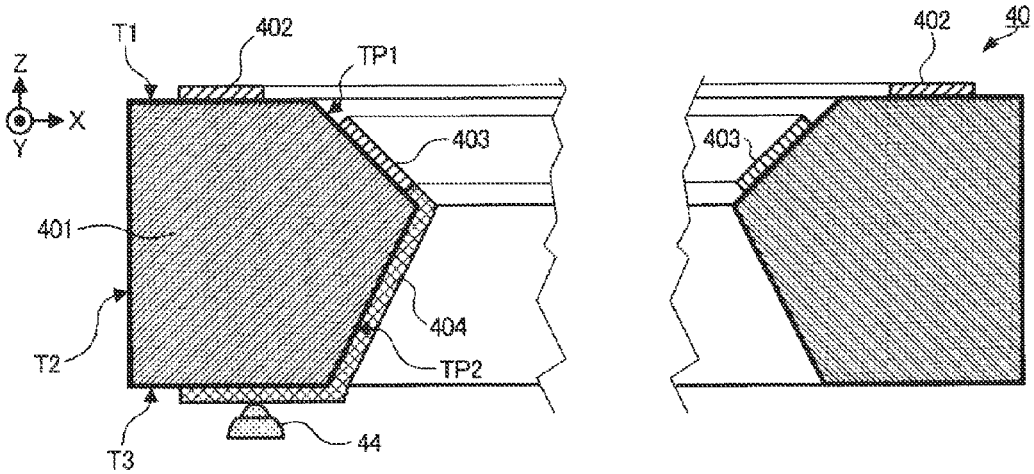

FIG. 6A to FIG. 6C describe the construction of the antenna 40.

FIG. 6A is an oblique view of the antenna 40, FIG. 6B is a plan view of the antenna 40, and FIG. 6C is a section view of the antenna 40 through line G-g in FIG. 6B.

The antenna 40 includes an annular base 401 made of plastic, ceramic, or other dielectric material, a parasitic element 402 formed on the surface of the base 401, a driven element 403, and a coupling part 404. The base 401 has a round opening 406 in the center. The parasitic element 402, driven element 403, and coupling part 404 are each made of metal or other conductive material, and can be formed by a plating or silver paste printing process. The dielectric constant of the base 401 material can be adjusted to approximately 5-20 by mixing a dielectric material that is used in high frequency applications, such as titanium oxide, with resin.

As shown in FIG. 6C, the base 401 has a pentagonal section including a top T1, outside face T2, bottom T3, slope TP1, and slope TP2. The parasitic element 402 is formed on the top T1, and the driven element 403 is formed on slope TP1. The coupling part 404 is formed on the slope TP1, slope TP2, and bottom T3. The end of the coupling part 404 on the slope TP1 side connects to the driven element 403, and the end on the bottom T3 side contacts the top of the feed pin 44. A specific potential is therefore supplied through the feed pin 44 and coupling part 404 to the driven element 403. Potential from an external source is not supplied to the parasitic element 402.

As shown in FIG. 6A and FIG. 6B, the parasitic element 402 is annular, that is, is formed in an endless O-shape. The driven element 403, however, has a notch 405, and is therefore C-shaped with part of the ring missing. The driven element 403 has an antenna length that resonates to signals (satellite signals) from a GPS satellite 20. For example, if the angle between the coupling part 404 and notch 405 is √a, the length of the notch 405 is •s, the circumferential length of the driven element 403 is L, and the free space wavelength of the received circularly polarized waves is •, then L=1.31•, •a=40°, and ⊗ s=0.018•.

The coupling part 404 is connected to an end of the C-shaped driven element 403. As shown in FIG. 6B, the part (end) of the driven element 403 to which the coupling part 404 is connected is a driven part 403*a* to which a specific potential is supplied. Note that the driven part 403*a* is not limited to being disposed to an end of the driven element 403, and can be at a part of the driven element 403 other than an end.

The driven part 403*a* is also disposed at approximately the 9:00 position of the electronic timepiece 100. More specifically, when the electronic timepiece 100 is seen in plan view, the driven part 403*a*, coupling part 404, and feed pin 44 are disposed at 9:00 relative to the center (center pivot 12) of the electronic timepiece 100. However, the location of the driven part 403*a*, coupling part 404, and feed pin 44 is not limited to 9:00 from the center of the electronic timepiece 100, and could be at 8:00, 10:00, 5:00, or 1:00, for example.

As shown in FIG. 6A and FIG. 6B, the parasitic element 402 and driven element 403 are disposed with a specific gap therebetween, and when current flows to the driven element 403, current is induced in the parasitic element 402. That is, the distance between the parasitic element 402 and driven element 403 is a distance enabling electromagnetic coupling therebetween. The driven element 403 and parasitic element 402 therefore couple electromagnetically, and together function as an antenna element that converts electromagnetic waves to current. Because the parasitic element 402 is O-shaped, the antenna 40 overall functions as an O-shaped loop antenna. The driven element 403 to which a specific potential is supplied and the ground plane 90 to which ground potential is supplied therefore resonate, and the electronic timepiece 100 can receive radio waves (satellite signals) from a GPS satellite 20.

Because GPS satellites 20 transmit satellite signals at 1.575 GHz, one wavelength is approximately 19 cm. Because an antenna length of approximately 1.0-1.2 wavelength is required to receive circularly polarized waves, a loop antenna of approximately 19-24 cm is required to receive a satellite signal. Rendering a loop antenna with this antenna length in a wristwatch, however, results in a large wristwatch.

For example, if the dielectric constant is •r and a base 401 with a dielectric constant of Σr is used, the wavelength shortening rate of the base 401 will be 1/√Σr. More specifically, the wavelength of the radio waves to be received by the antenna 40 can be shortened 1/√Σr times by using a dielectric with a dielectric constant of •r. As described above, because the dielectric constant •r of the base 401 is approximately 5-20, the antenna length of the antenna 40 can be shortened approximately 0.224 (Σr=20) to 0.447 (•r=5) times compared with a configuration not using the base 401.

The resonance frequency of the antenna 40 can also be reduced and the impedance characteristic can be improved by electromagnetically coupling the parasitic element 402 to the driven element 403. Return loss at the resonance frequency can therefore be reduced, and the satellite signal reception performance of the antenna 40 can be increased by adjusting the resonance frequency of the antenna 40 to the satellite signal.

Note that contact resistance can be kept low for a long time and a drop in the reception performance of the antenna 40 can be prevented by also applying gold plating or anticorrosion coating process to the contact surfaces of the feed pin 44 and coupling part 404, and the contact surfaces of the feed pin 44 and circuit board 25.

Figure 7:
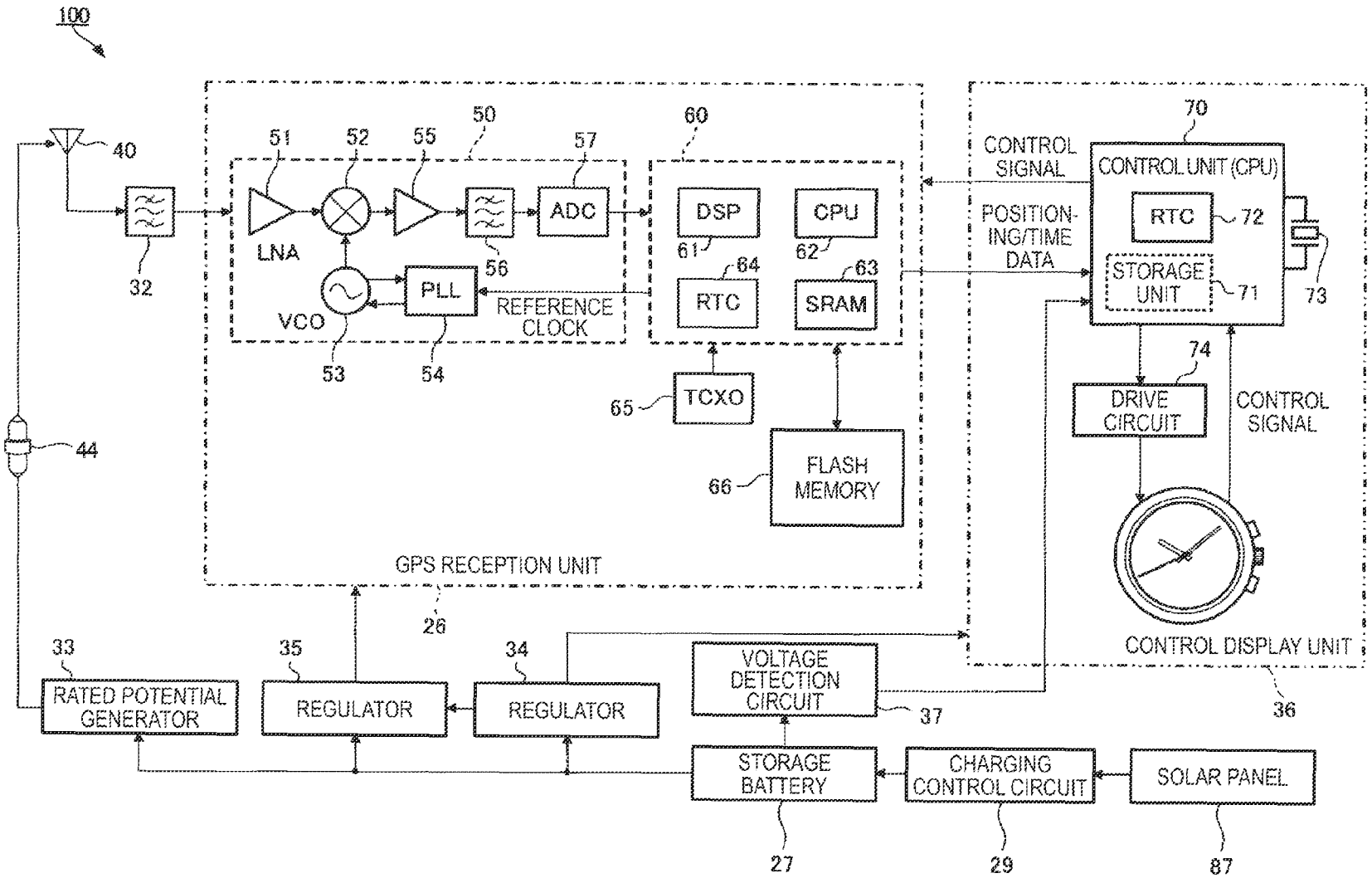
FIG. 7 is a block diagram showing the circuit configuration of the electronic timepiece.

FIG. 7 is a block diagram showing the circuit configuration of the electronic timepiece 100.

The electronic timepiece 100 includes a GPS reception unit 26 and a control display unit 36. The GPS reception unit 26 executes processes related to receiving satellite signals, locking onto GPS satellites 20, generating positioning information, and generating time adjustment information, for example. The control display unit 36 executes processes including keeping and adjusting the internal time, and movement of the hands 13.

A solar panel 87 charges the storage battery 27 through the charging control circuit 29. The storage battery 27 supplies drive power through a regulator 34 to the control display unit 36, and supplies drive power through another regulator 35 to the GPS reception unit 26. A voltage detection circuit 37 detects the voltage of the storage battery 27 and outputs to a control unit 70.

Regulator 35 could be split into a regulator that supplies drive power to the RF (radio frequency) unit 50, and a regulator that supplies drive power to a baseband unit 60. In this case, the regulator that supplies power to the RF unit 50 could be disposed in the RF unit 50.

A rated potential generator 33 generates a specific potential with a predetermined potential difference to ground. The specific potential generated by the rated potential generator 33 is supplied through the circuit board 25 and feed pin 44 to the antenna 40 (driven element 403).

The antenna 40 receives satellite signals from GPS satellites 20. However, because some extraneous signals other than the desired satellite signals are also received, a SAW (surface acoustic wave) filter 32 is disposed after the antenna 40. The SAW filter 32 functions as a bandpass filter that passes signals in the 1.5 GHz waveband, and extracts the satellite signal from the signals received by the antenna 40.

The GPS reception unit 26 includes the RF unit 50 and baseband unit 60. The RF unit 50 includes a LNA (low noise amplifier) 51, mixer 52, VCO (voltage controlled oscillator) 53, PLL (phase-locked loop) circuit 54, IF (intermediate frequency) amplifier 55, IF filter 56, and A/D converter 57.

Signals (satellite signals) passed by the SAW filter 32 are input to the RF unit 50 and amplified by the LNA 51. The satellite signal amplified by the LNA 51 is mixed by the mixer 52 with the clock signal output by the VCO 53, and down-converted to a signal in the intermediate frequency band. The PLL circuit 54 phase compares a clock signal obtained by frequency dividing the output clock signal of the VCO 53 with a reference clock signal supplied from the baseband unit 60, and synchronizes the output clock signal of the VCO 53 to the reference clock signal. As a result, the VCO 53 can output a stable clock signal with high frequency precision. Note that several megahertz, for example, can be selected as the intermediate frequency.

The signal in the IF band output from the mixer 52 is amplified by the IF amplifier 55. However, because mixing by the mixer 52 produces a high frequency component of several GHz, the IF amplifier 55 amplifies both the IF signal and the high frequency component of several GHz. As a result, the IF filter 56 extracts the IF signal and removes the high frequency component (more accurately, attenuates the signal to a specific level or less). The IF signal passed by the IF filter 56 is converted to a digital signal by the A/D converter 57.

The baseband unit 60 includes, for example, a DSP (digital signal processor) 61, CPU (central processing unit) 62, SRAM (static random access memory) 63, and RTC (real-time clock) 64. A TCXO (temperature compensated crystal oscillator) 65 and flash memory 66 are also connected to the baseband unit 60.

The TCXO 65 generates a reference clock signal of a substantially constant frequency regardless of temperature. Operation of the baseband unit 60 is synchronized to the reference clock signal output by the TCXO 65. The RTC 64 generates the timing for satellite signal processing, and counts up at the reference clock signal output from the TCXO 65.

Time zone information, for example, is stored in flash memory 66. The time zone information defines the time difference to UTC related to known coordinates (such as latitude and longitude).

The baseband unit 60 executes a process that demodulates the baseband signal from the digital signal (IF signal) output from the A/D converter 57 of the RF unit 50 when the time information acquisition mode or the positioning information acquisition mode is set.

In addition, when the time information acquisition mode or the positioning information acquisition mode is set, the baseband unit 60 executes a process that generates a local code of the same pattern as each C/A code, and correlates the local codes to the C/A code contained in the baseband signal, in the satellite search step. The baseband unit 60 adjusts the timing when the local code is generated to find the peak correlation to each local code, and when the correlation equals or exceeds a threshold value, determines that the local code synchronized with the GPS satellite 20 (that is, locked onto a GPS satellite 20). Note that the GPS system uses a CDMA (Code Division Multiple Access) method whereby all GPS satellites 20 transmit satellite signals on the same frequency using different C/A codes. The GPS satellites 20 that can be locked onto can therefore be found by identifying the C/A code contained in the received satellite signal.

To acquire the navigation message from the satellite signal of the GPS satellite 20 that was locked onto, the baseband unit 60 also executes a process that mixes the baseband signal with the local code of the same pattern as the C/A code of the GPS satellite 20 that was locked. The navigation message from the GPS satellite 20 that was locked onto is thereby demodulated. The baseband unit 60 then executes a process to detect the TLM word (preamble data) of each subframe in the navigation message, and acquire and store in SRAM 63 satellite information such as the orbit information and GPS time information contained in each subframe. The GPS time information as used here is the week number (WN) and Z count, but the Z count data alone could be acquired if the week number was previously acquired.

The baseband unit 60 then generates the time adjustment information based on the satellite information. The time adjustment information is information for correcting the internal time kept by the electronic timepiece 100.

In the time information acquisition mode, the baseband unit 60 can generate the time adjustment information using the GPS time information, time adjustment parameter, or UTC offset contained in the satellite information from one GPS satellite 20, for example. The baseband unit 60 can also generate the time adjustment information from satellite information from a plurality of GPS satellites 20. The time adjustment information in the time information acquisition mode could be, for example, the GPS time information itself, the GPS time information after being corrected based on the time adjustment parameter, or time information acquired by adding the time adjustment parameter or UTC offset to the GPS time information. Further alternatively, information indicating the difference between this time information and the internal time of the electronic timepiece 100 could be used as the time adjustment information.

However, in the positioning information acquisition mode, the baseband unit 60 receives satellite information from at least three (and normally four) or more GPS satellites 20, and acquires the location of the electronic timepiece 100 using the received satellite information. Next, the baseband unit 60 references the time difference information stored in flash memory 66, and acquires the time difference at the acquired location. The baseband unit 60 then adds the acquired time difference to the time adjustment information generated using the same method used in the time information acquisition mode. The time adjustment information used in the positioning information acquisition mode therefore reflects the time difference at the current location of the electronic timepiece 100.

The control display unit 36 includes a control unit 70, crystal oscillator 73, and drive circuit 74.

The control unit 70 can be rendered by a configuration including a storage unit 71 and a CPU with a RTC (real-time clock) 72.

The control unit 70 outputs control signals to the GPS reception unit 26, and controls operation of the GPS reception unit 26. The control unit 70 also controls movement of the hands 13 (13*a* to 13*c*) through the drive circuit 74. The control unit 70 also controls operation of regulators 34, 35 and the rated potential generator 33 based on output from the voltage detection circuit 37.

The time adjustment information and positioning information output from the GPS reception unit 26 are stored in the storage unit 71. The RTC 72 keeps the internal time. The RTC 72 operates continuously, and counts up at the reference clock signal generated by the crystal oscillator 73. Whether the time information acquisition mode or the positioning information acquisition mode is set, the control unit 70 can therefore continue moving the hands 13 based on the internal time kept by the RTC 72.

When time adjustment information is output from the GPS reception unit 26 in the time information acquisition mode or the positioning information acquisition mode, the control unit 70 corrects the internal time kept by the RTC 72 according to the time adjustment information. When the internal time is corrected, the control unit 70 also drives the hands 13 through the drive circuit 74 so that the hands 13 (13*a* to 13*c*) indicate the internal time after being corrected. As a result, the internal time of the electronic timepiece 100 is set to the correct time. In the positioning information acquisition mode, the internal time can also be adjusted to the correct time reflecting the time difference (time zone) at the current location of the electronic timepiece 100.

In the embodiment of the invention described above, the base 401 (dielectric) of the antenna 40 and the ground plane 90 both have an annular shape, and have an opening 406, 90*c* on the inside part of the ring. The ground plane 90 is disposed coaxially to the base 401 to which the driven element 403 is disposed, and the gap •d in the axial direction (z-axis) therebetween is less than or equal to the thickness h of the base 401 on the z-axis. In this configuration the base 401 and ground plane 90 are superimposed on the z-axis so that at least part of the openings 406, 90*c* thereof overlap. As a result, the opening 406 in the base 401 of the antenna 40 is not blocked by the ground plane 90, and the reception performance of the antenna 40 can be increased compared with the configuration disclosed in JP-A-2011-021929 because the mag flux passing through the loop plane of the loop antenna can be increased.

Plural supply parts (conductive pins 93 and conductive springs 90*a*) to which ground potential is supplied are disposed at equiangular intervals to the center C of the annular ground plane 90 in this embodiment. To produce resonance between the driven element 403 and ground plane 90 and receive a satellite signal, the potential difference between the driven element 403 and ground plane 90 must be held constant, and the stability of the ground potential in the ground plane 90 greatly affects the sensitivity and directivity of the antenna 40. More particularly, when the shape of the ground plane 90 is a ring, the distribution of the ground potential in the ground plane 90 can easily become uneven if there is a single supply part, resulting in a loss of reception performance and variation in directivity in the antenna 40. Therefore, by disposing plural supply parts on the ground plane 90 at equiangular positions around the center C, the ground potential in the ground plane 90 can be stabilized, the reception performance of the antenna 40 improved, and good directivity maintained.

The reception performance of the antenna 40 can also be improved in this embodiment because the case 80 and back cover 85 of the outside case function as a ground plane, and reflect satellite signals input from the crystal 84 side toward the antenna 40.

This embodiment can also lower the resonance frequency of the antenna 40 and improve impedance characteristics by electromagnetically coupling the parasitic element 402 and driven element 403. Return loss at the resonance frequency can therefore be reduced, and the satellite signal reception performance of the antenna 40 improved, by matching the resonance frequency of the antenna 40 to the satellite signal.

The invention is not limited to the foregoing embodiment, and can be varied in many ways such as described in the following variations. Two or more of the variations described below can also be desirably combined.

Variation 1

Figure 8:
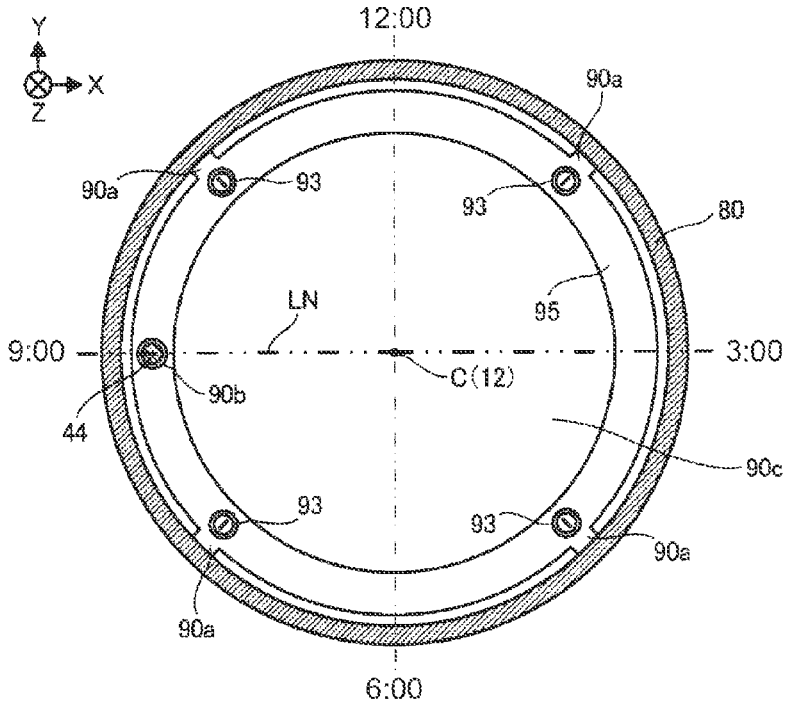
FIG. 8 is a plan view showing the ground plane and casing in variation 1 of the preferred embodiment.

FIG. 8 is a plan view showing the ground plane 95 and case 80 in variation 1. In the ground plane 95 according to this variation, plural supply parts (conductive pins 93 and conductive springs 90*a*) are disposed line symmetrically to the line LN between the center C of the ground plane 95 ring and the feed pin 44. When the antenna 40 is seen in plan view on the z-axis, the position of the feed pin 44 is at the position of the driven part 403*a* of the driven element 403. The ground potential in the ground plane 95 can also be stabilized, the reception performance of the antenna 40 can be improved, and good directivity can be maintained when plural supply parts are disposed line symmetrically to line LN. More particularly, because delay of the high frequency component in the driven element 403 can be reduced symmetrically on both sides of the driven part 403*a* by providing plural supply parts line symmetrically to line LN, good directivity can be maintained in the antenna 40.

Variation 2

Figure 9:
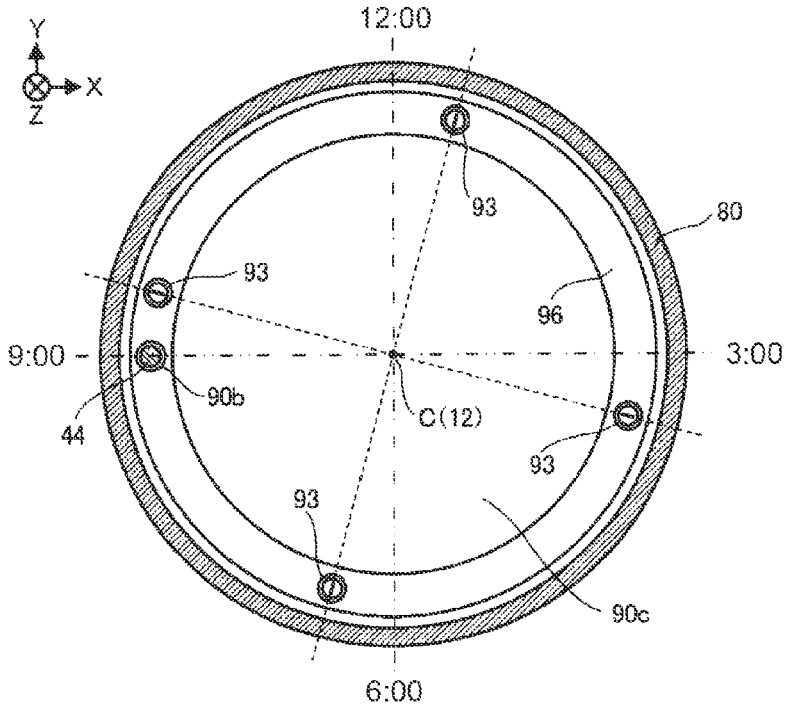
FIG. 9 is a plan view showing the ground plane and casing in variation 2 of the preferred embodiment.

FIG. 9 is a plan view showing the ground plane 96 and case 80 in variation 2. The ground plane 96 according to this variation differs from the ground plane 90 shown in FIG. 5 in that (4) conductive springs 90*a* are not used. The ground plane 96 can thus be embodied with only the conductive pin 93 parts of the conductive pins 93 and conductive springs 90*a*. Conversely, the ground plane 96 can also be embodied with only the conductive springs 90*a*.

Variation 3

Figure 10:
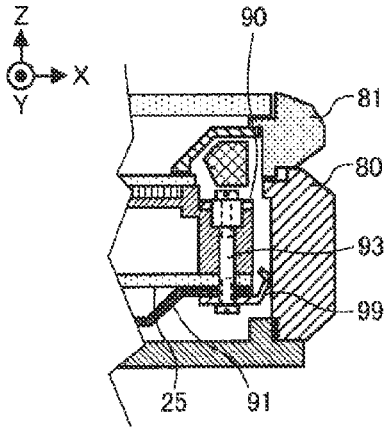
FIG. 10 shows a variation of the location of a conductive spring.

The conductive pins 93 and conductive springs 90*a* are also not limited to four, and there may be one or more. The conductive pins 93 and conductive springs 90*a* are also not limited to equiangular positions from the center C. The conductive springs 90*a* and ground plane 90 can also be separate parts with the conductive springs 90*a* attached to the ground plane 90 using screws or other means. As shown in FIG. 10, conductive springs 99 discrete from the ground plane 90 can also be affixed by the conductive pins 93 to the bottom of the circuit board 25 together with the shield 91. The ground plane 90 can also be embodied with a conductive coating formed on the surface of an annular member made of a non-conductive material.

Variation 4

Figure 11:
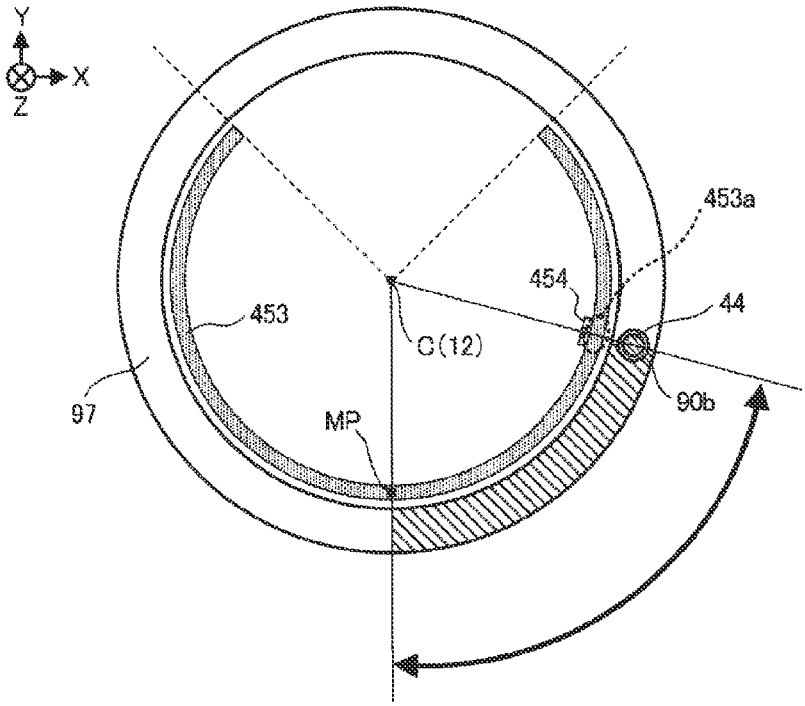
FIG. 11 is a plan view showing the ground plane and a C-shaped driven element in variation 4 of the preferred embodiment.

FIG. 11 is a plan view of a ground plane 97 and C-shaped driven element 453 according to variation 4. The driven element 453 is shown inside the ground plane 97 in the figure, but because the base 401 of the antenna 40 is actually disposed above the ground plane 97, and the driven element 453 is disposed to slope TP1 of the base 401, the ground plane 97 and driven element 453 overlap on the z-axis. To produce desirable resonance between the C-shaped driven element 453 disposed to the base 401 and the annular (O-shaped) ground plane 97, the ground potential must be stable in the part of the ground plane 97 overlapping the driven element 453. Therefore, when there is only one supply part (conductive pin 93 or conductive spring 90*a*) disposed to the ground plane 97, the supply part is preferably in the area of the ground plane 97 overlapping the driven element 453, such as disposing the supply part at the part corresponding to the midpoint MP between the ends of the driven element 453. Furthermore, considering delay of the high frequency component in the driven element 453, if the driven element 453 is divided into two parts by the driven part 453*a*, the supply part is preferably disposed to the long side.

Based on the foregoing, when only one supply part is disposed to the ground plane 97, the conductive pin 93 or conductive spring 90*a* is desirably disposed to the part corresponding to the area from the midpoint MP between the ends of the driven element 453 to the driven part 453*a* (the shaded part in the figure). By thus disposing the supply part, the reception performance of the antenna 40 can be improved and good directivity can be maintained because the ground potential in the part of the ground plane 97 superimposed with the driven element 453 can be efficiently stabilized when only one supply part is disposed to the ground plane 97.

Variation 5

Figure 12:
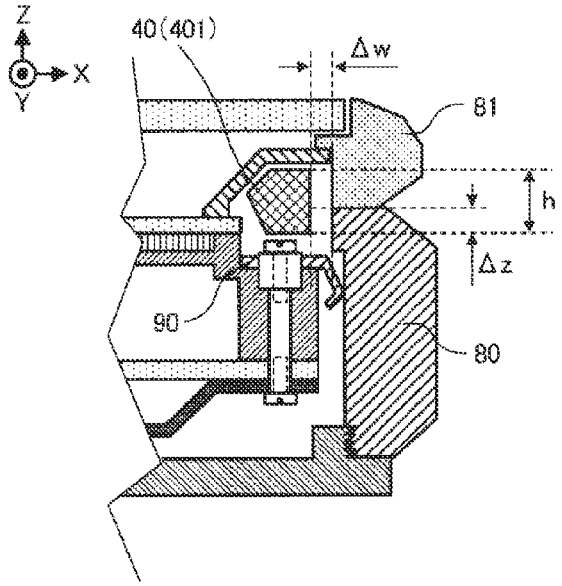
FIG. 12 is a section view showing main parts of an electronic timepiece in variation 5 of the preferred embodiment.

The electronic timepiece 100 described above receives satellite signals by producing resonance between the driven element 403 and ground plane 90, but the conductive members to which ground potential is supplied near the antenna 40 include the case 80 in addition to the ground plane 90. The driven element 403 and the case 80 can therefore be made to resonate. In this implementation the gap ⊗w between the inside circumference surface of the case 80 and the outside circumference surface of the base 401 must be h or less, where h is the thickness on the z-axis of the base 401 (dielectric) of the antenna 40, as shown in FIG. 12. The top of the case 80 must also be higher than the bottom of the base 401, and the overlap ⊗z on the z-axis between the case 80 and the base 401 must be ⅕ or more of the thickness h of the base 401 on the z-axis. Because the case 80 and the ground plane 90 both resonate with the driven element 403 in this configuration, the reception performance of the antenna 40 can be improved and good directivity can be maintained. The size of the ground plane 90 can also be reduced by thus including the case 80 as a resonance component.

Variation 6

In the antenna 40 shown in FIG. 6, the parasitic element 402 is not limited to an endless O-shape, and like the driven element 403 can be C-shaped with a notch. In this variation the entire antenna 40 functions as a C-shaped loop antenna. The length of the driven element 403 in the foregoing embodiment is also determined to resonate to the satellite signal, but the length of the parasitic element 402 can be set to resonate to the satellite signal. By adjusting the length of the driven element 403 and the position of the notch 405 in this configuration, the impedance between the antenna 40 and the circuit (the circuit block including the GPS reception unit 26 and control unit 70) electrically connected to the antenna 40 can be easily matched.

Variation 7

Figure 13:
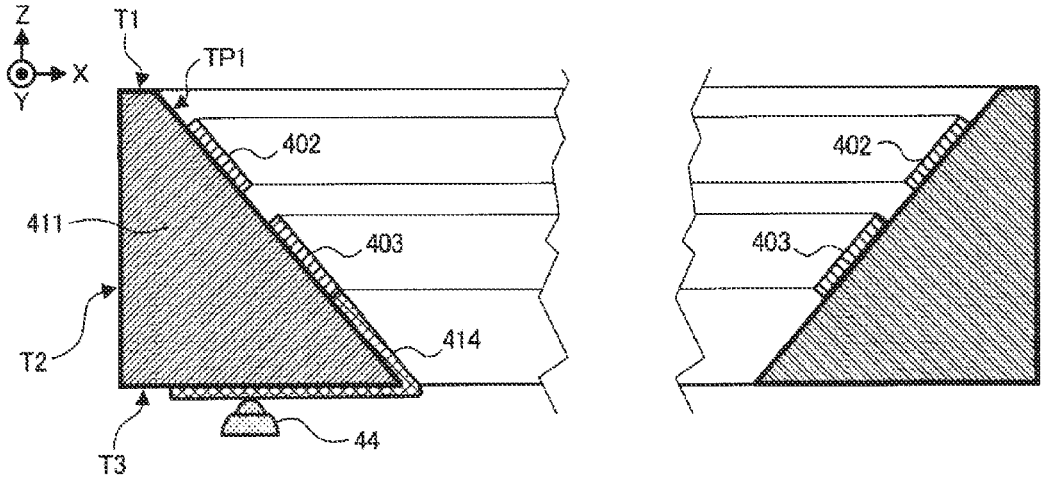
FIG. 13 is a section view of the antenna in variation 7 of the preferred embodiment.

FIG. 13 is a section view of the antenna in variation 7, and is the same as the view in FIG. 6C. The base 411 of the antenna in this variation does not have a slope TP2, and slope TP1 continues to the bottom T3. The top T1 of the base 411 is smaller and the slope TP1 is larger than the configuration shown in FIG. 6C. The parasitic element 402 is formed in addition to the driven element 403 on the slope TP1, and nothing is disposed to the top T1. Both the driven element 403 and parasitic element 402 can thus be disposed to slope TP1.

Variation 8

Figure 14:
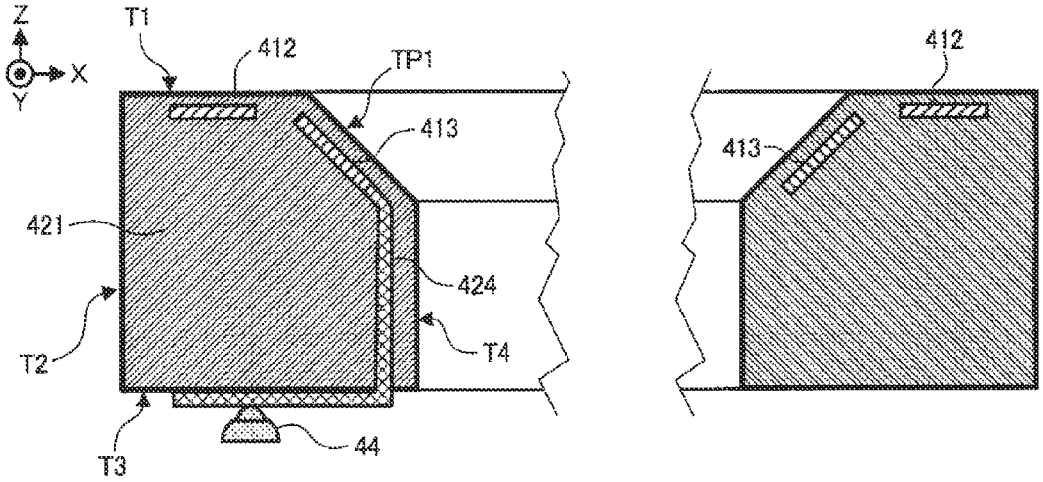
FIG. 14 is a section view of the antenna in variation 8 of the preferred embodiment.

FIG. 14 is a section view of the antenna in variation 8, and is the same as the view in FIG. 6C. The base 421 of the antenna in this variation has a vertical inside face T4 instead of a slope TP2. All of the parasitic element 412 and the driven element 413, and part of the coupling part 424, are embedded in the base 421. This configuration can be manufactured by insert molding. Insert molding enables manufacturing the antenna at a lower cost than when the parasitic element 402, driven element 403, and coupling part 404 are formed on the surface of the base 401 as shown in FIG. 6C by a plating or silver paste printing process.

Variation 9

Figure 15:
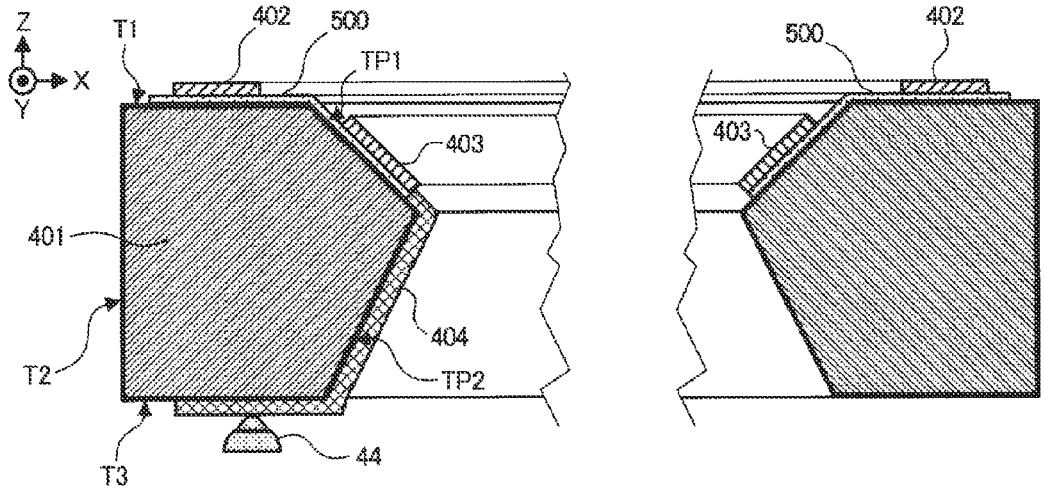
FIG. 15 is a section view of the antenna in variation 9 of the preferred embodiment.

FIG. 15 is a section view of the antenna in variation 9, and is the same as the view in FIG. 6C. As shown in the figure, the parasitic element 402 and driven element 403 are affixed to the base 401 by flexible tape 500. This configuration can be manufactured, for example, by forming the parasitic element 402 and driven element 403 on flexible tape 500, and affixing the flexible tape 500 to the surface of the base 401 (top T1 and slope TP1). This manufacturing method enables manufacturing the antenna at a lower cost than when the parasitic element 402 and driven element 403 are formed directly on the surface of the base 401 by a plating or silver paste printing process.

Further alternatively, the coupling part 404 can also be affixed to the base 401 using the flexible tape 500.

Variation 10

Figure 16:
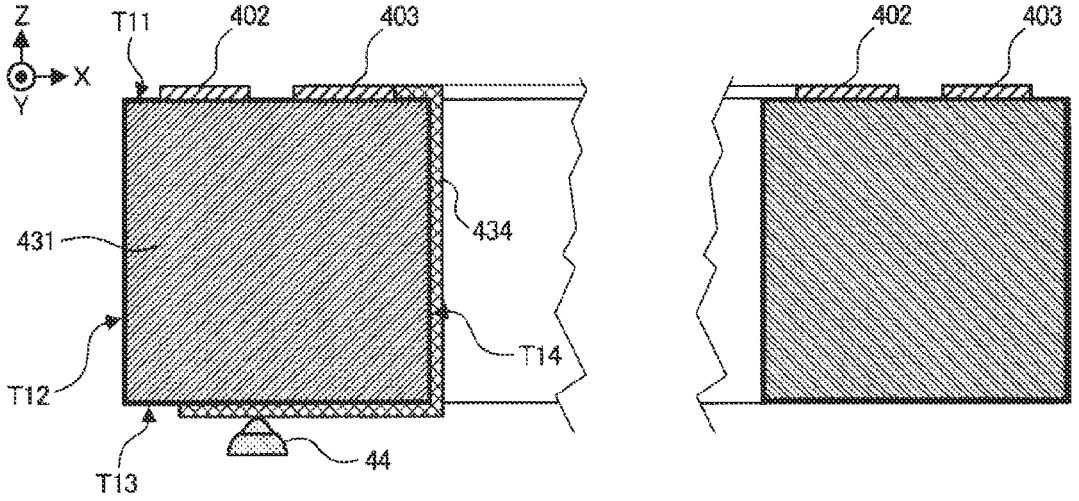
FIG. 16 is a section view of the antenna in variation 10 of the preferred embodiment.

FIG. 16 is a section view of the antenna in variation 10, and is the same as the view in FIG. 6C. The base 431 of the antenna in this variation is a rectangle with a top T11, outside face T12, bottom T13, and inside face T14. The parasitic element 402 and driven element 403 are formed on the top T11. The coupling part 434 is formed on the top T11, inside face T14, and bottom T13. The base 431 in this configuration does not need to have a slope TP1. The locations of the parasitic element 402 and driven element 403 can also be reversed. More specifically, the driven element 403 can be on the outside of the parasitic element 402. In this implementation the coupling part 434 is formed on the top T11, outside face T12, and bottom T13. If the coupling part 434 is thus formed on the outside face T12, the case 80 is preferably made of a plastic, ceramic, or other non-conductive material.

Variation 11

Instead of using a feed pin 44, a leaf spring, lead, coaxial cable, or flexible printed circuit can be used to electrically connect the coupling part 404 of the antenna 40 and the circuit board 25, and supply a specific potential.

Variation 12

Figure 17:
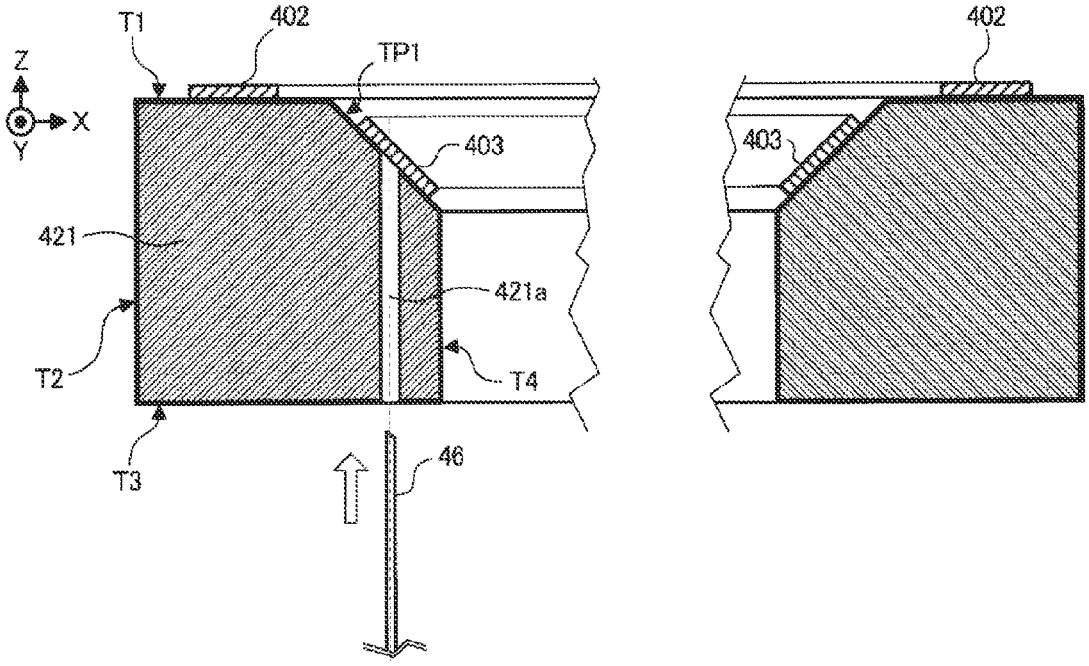
FIG. 17 is a section view of the antenna in variation 12 of the preferred embodiment.

FIG. 17 is a section view of the antenna in variation 12, and is the same as the view in FIG. 6C. The antenna in this variation differs from the antenna 40 shown in FIG. 6 in that (1) the base 421 has a vertical inside face T4 instead of slope TP2, (2) there is no coupling part 404, and (3) a hole 421*a* is formed from the slope TP1 to the bottom T3 of the base 421. When the antenna according to this variation is used, a rod-shaped feed pin 46 is used instead of the feed pin 44 described above. This feed pin 46 is made of metal or other conductive material, one end is inserted to the hole 421*a*, and the distal end thereof is connected to the driven element 403. The other end of the feed pin 46 is connected to the wiring pattern on the circuit board 25, and a specific potential is supplied thereto. With this configuration there is no need to form a coupling part 404 on the surface of the base 421 (dielectric). Disposing a coupling part 404 to the antenna is thus not necessary.

Variation 13

Figure 18A:
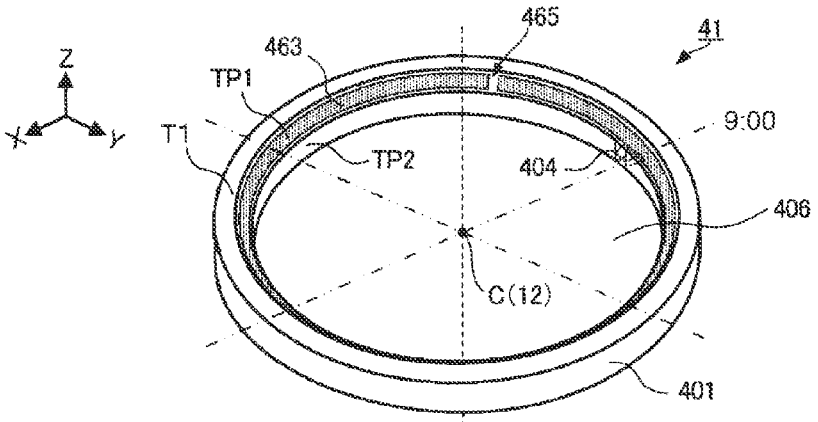
FIG. 18A to FIG. 18C are used to describe the structure of the antenna in variation 13 of the preferred embodiment.
Figure 18B:
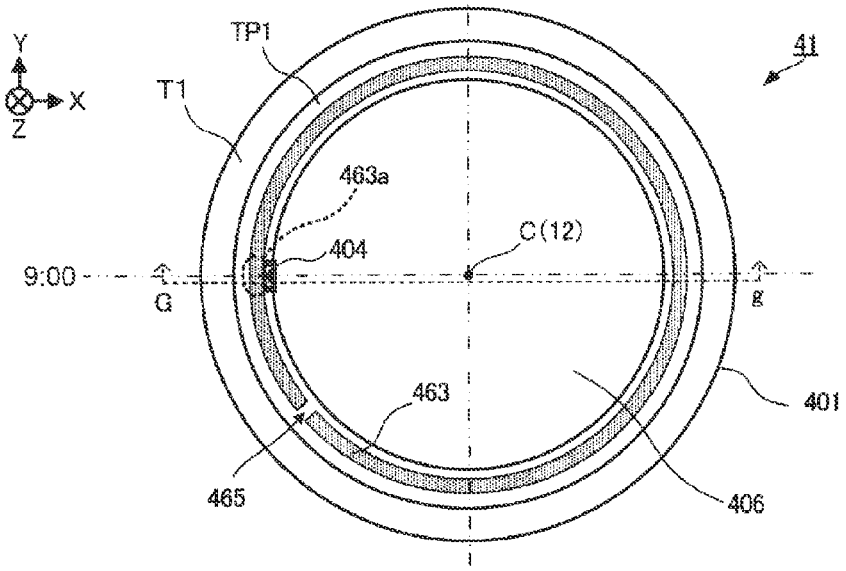
Figure 18C:
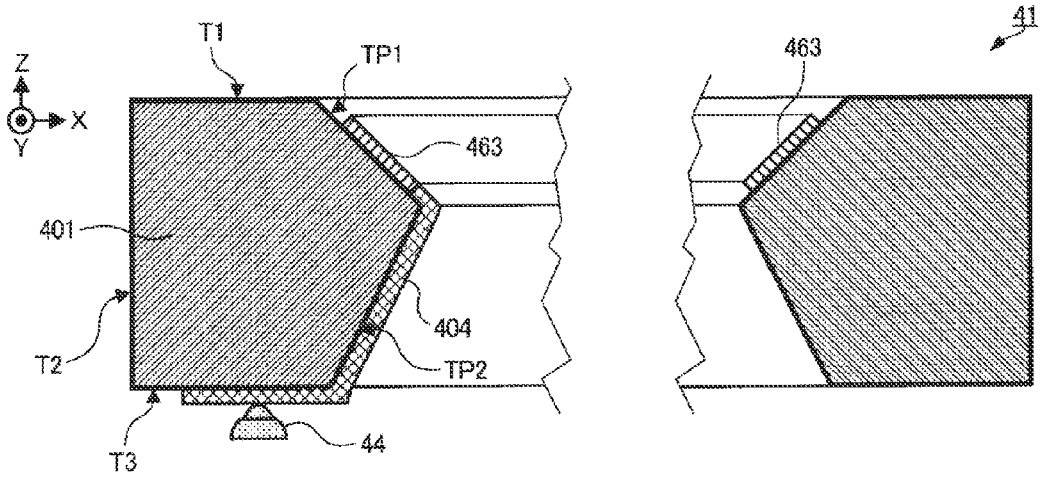

FIG. 18A to FIG. 18C show the configuration of an antenna 41 in variation 13. The antenna 41 according to this variation differs from the antenna 40 shown in FIG. 6 in that (1) there is no parasitic element 402, and (2) the driven part 463*a* is disposed to a part of the driven element 463 other than the end. The antenna can thus be embodied without a parasitic element 402. This also applies to the antennae shown in FIG. 13 to FIG. 17. Note, further, that the driven element 463 may be an endless O-shape without a notch 465.

Variation 14

The second hand 13*a* can be omitted. The time display unit is also not limited to indicating the time by rotating hands 13 over a dial 11, and could have an LCD panel with a display area of a size equal to the dial 11, and display the time by displaying an image of a dial 11 and hands 13 in the display area.

Variation 15

Figure 19:
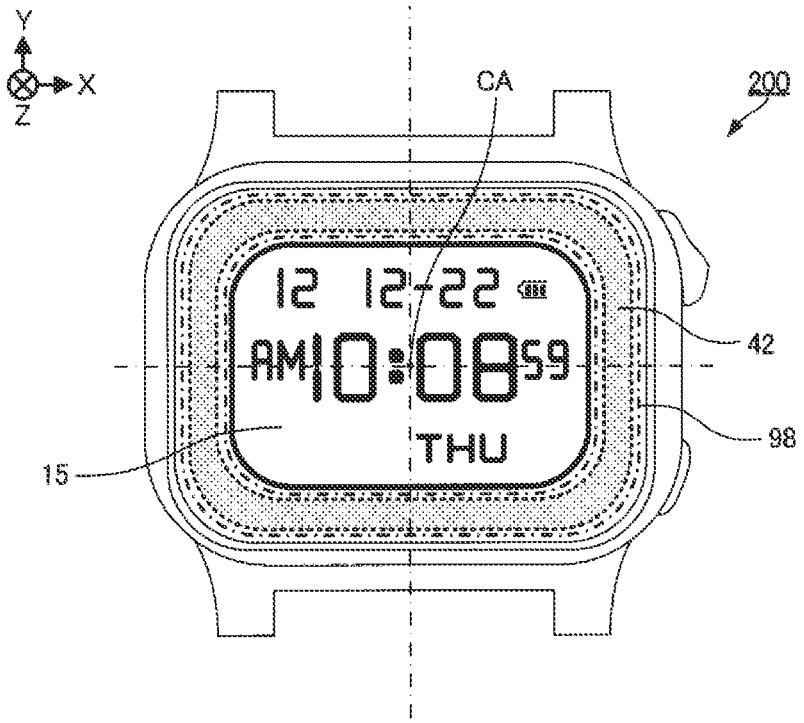
FIG. 19 is a plan view of the electronic timepiece in variation 15 of the preferred embodiment.

FIG. 19 is a plan view of an electronic timepiece 200 according to variation 15.

The electronic timepiece 200 in this variation has a rectangular case in which an annular antenna 42, annular ground plane 98, and LCD panel 15 are housed. The LCD panel 15 displays time digitally. The antenna 42 and ground plane 98 are both substantially rectangular annular shapes disposed coaxially to the center point CA. While the shape of the ring differs from the antenna 40 shown in FIG. 6, the antenna 42 similarly has a base (dielectric), parasitic element, driven element, and coupling part, and a specific potential is supplied to the driven element through the feed pin and coupling part. In addition, while the shape of the ring differs from the ground plane 90 shown in FIG. 5, the ground plane 98 also includes a plurality of conductive pins and conductive springs, and the ground potential is supplied thereto through these conductive pins and conductive springs.

As described with the antenna 40 and ground plane 90 above, the distance on the z-axis between the antenna 42 and ground plane 98 is less than or equal to h, where h is the thickness on the z-axis of the base (dielectric) of the antenna 42. The antenna 42 and ground plane 98 thus have the same center CA, and are disposed on the z-axis with a gap therebetween of h or less on the z-axis. The electronic timepiece with internal antenna according to the invention can thus display time digitally, and the annular shape of the dielectric and ground plane can also be a rectangle or other polygon, or an oval.

Variation 16

The antenna 40 (base 401) and ground plane 90 do not need to be disposed coaxially. What is essential is that the opening 406 in the base 401 and the opening 90*c* in the ground plane 90 overlap each other at least in part when the electronic timepiece 100 is seen in plan view (that is, when the base 401 and ground plane 90 are seen in line with the center axis of the rings). In addition, the gap ⊗ d between the antenna 40 (base 401) and the ground plane 90 must be less than or equal to the distance at which the ground plane 90 and driven element 403 can be made to resonate. This also applies to variation 15, for example.

Variation 17

The side of the case in the foregoing embodiments includes the case 80 and bezel 81, but the side of the case can be manufactured as a single member by molding a plastic, ceramic, or other non-conductive material.

A charging method other than solar charging may also be used. For example, a charging coil can be used to charge the storage battery with power produced by electromagnetic induction from an external charger.

A lithium battery or other primary cell can also be used instead of a storage battery 27.

Variation 18

The foregoing embodiments are described using GPS satellites, but the invention is not so limited and can be used with Global Navigation Satellite Systems (GNSS) such as Galileo (EU), GLONASS (Russia), Beidou (China), and IRNSS (India), as well as the Satellite Based Augmentation System (SBAS) or the Quasi-Zenith Satellite System (QZSS). An electronic timepiece with internal antenna according to the invention can thus receive radio signals from manmade satellites other than GPS satellites 20 to adjust the internal time. The electronic timepiece with internal antenna according to the invention is also not limited to radio signals from manmade satellites, and the invention can also be applied in an electronic timepiece that receives 900 MHz band signals for RF tags.

Variation 19

An electronic timepiece with internal antenna according to the invention is not limited to wristwatches, and could be a pocket watch or table clock, for example. The invention can also be used in electronic devices with an electronic timepiece function (such as cell phones and digital cameras).

Although the present invention has been described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims, unless they depart therefrom.

The entire disclosure of Japanese Patent Application No. 2012-209024, filed Sep. 24, 2012 is expressly incorporated by reference herein.

What is claimed is:

1. An electronic timepiece with internal antenna, comprising:

a time display unit that displays time;

an annular dielectric body that is housed in the case and has disposed thereto a conductive driven element to which a specific potential is supplied; and a conductive ground plane with an annular shape that is supplied with ground potential;

wherein the dielectric body and the ground plane are disposed coaxially to the same center axis with the gap therebetween in the axial direction less than or equal to the thickness of the dielectric in the axial direction.

2. The electronic timepiece with internal antenna described in claim 1, wherein:

the ground plane has a plurality of supply parts to which the ground potential is supplied.

3. The electronic timepiece with internal antenna described in claim 2, wherein:

the plural supply parts are disposed at equal angles from the center of the ground plane ring.

4. The electronic timepiece with internal antenna described in claim 2, wherein:

the driven element is an endless ring or a ring with a notch therein, and when the dielectric and ground plane are seen in plan view from the axial direction of the ring, the plural supply parts are disposed symmetrically to a line joining the center of the ground plane ring and the driven part.

5. The electronic timepiece with internal antenna described in claim 1, wherein:

the driven element is a ring with a notch therein, and has one driven part to which the specific potential is fed;

a supply part to which the ground potential is supplied is disposed to one place on the ground plane; and when the dielectric and ground plane are seen in plan view from the axial direction of the ring, the supply part is disposed to apart in a range from the midpoint between the ends of the driven element and the driven part.

6. The electronic timepiece with internal antenna described in claim 1, further comprising:

a case that has a conductive case body that has a cylindrical shape and is supplied with the ground potential, wherein an annular dielectric body is housed in the case;

the gap between the inside surface of the case body and the outside surface of the dielectric is less than or equal to the thickness of the dielectric; and the overlap of the case body and the dielectric in the axial direction is greater than or equal to ⅕ the thickness of the dielectric.

7. The electronic timepiece with internal antenna described in claim 1, further comprising:

a case that has a conductive case body with a cylindrical shape, and a conductive back cover connected to the case body; wherein the ground potential is supplied to the case body and the back cover.

8. The electronic timepiece with internal antenna described in claim 1, wherein:

a conductive parasitic element that is an endless ring or a ring with a notch therein is disposed to the dielectric with a gap to the driven element.

* * * * *